United States Patent [19]

Denmat

[11] 4,383,565

[45] May 17, 1983

[54] LENS PROTECTION CASE

[76] Inventor: David A. Denmat, 316 Upper Tilden Ave., New Hartford, N.Y. 13413

[21] Appl. No.: 230,513

[22] Filed: Feb. 2, 1981

[51] Int. Cl.[3] ..... B65D 85/38

[52] U.S. Cl. ..... 150/52 J; 206/316; 206/523

[58] Field of Search ..... 206/316, 578, 523, 592, 206/594; 150/52 J; 350/65

[56] References Cited

U.S. PATENT DOCUMENTS

| | | | |
|---|---|---|---|
| 2,780,348 | 2/1957 | Harter et al. | 206/316 |
| 3,120,319 | 2/1964 | Buddrus | 206/523 X |
| 4,172,485 | 10/1979 | Mathieu | 150/52 J |
| 4,177,894 | 12/1979 | Petersen | 206/316 |

*Primary Examiner*—Donald F. Norton
*Attorney, Agent, or Firm*—Bruns & Jenney

[57] ABSTRACT

A lens case for a camera lens which can be used to protect the lens when it is either mounted upon a camera or removed therefrom. The protective case includes an elongated housing that is closed at one end by a blind wall and opened at the other to permit the case to be slipped over the lens. An end cap is provided which is capable of being slidably received over either end of the housing. When the case is used to protect a lens mounted upon a camera, the end cap is positioned over the closed end of the housing to act as a shock absorber to provide added protection to the lens. When the case is used to protect a lens that is removed from the camera, the end cap is positioned over the open end of the housing to provide a tightly sealed closure.

12 Claims, 5 Drawing Figures

LENS PROTECTION CASE

BACKGROUND OF THE INVENTION

This invention relates to a protective case for a camera lens that can be used with equal effectiveness when the lens is mounted upon a camera body or is removed therefrom.

Interchangeable lens systems capable of carrying out different tasks are usually provided for in most advanced cameras. The lenses are removably secured to the camera body by means of a standard size coupling that permits one special lens to be rapidly disconnected from the camera and replaced with another. Oftentimes, a photographer will be obligated to carry a number of lenses on his person when travelling or working upon an assignment. Lenses not actually mounted upon the camera were usually protectively stored in individual containers of the type disclosed in U.S. Pat. Nos. 4,177,894 and 2,780,348. Although these devices are ideal for storage, they cannot be used to protect the lens once the lens is mounted upon the camera. Further, because of their complex structure, considerable time must be expended when changing lenses and, as a consequence, many unposed pictures requiring rapid action are lost.

Interchangeable lens systems, as provided by many manufacturers, come equipped with lens caps that are adapted to be fitted over the distal end of the lens barrel to protect the last or exposed optical element in the system. The cap can be utilized when the lens is mounted on the camera case and does a good job of preventing the optics from becoming scratched or otherwise damaged. However, the major portion of the lens barrel remains unprotected. Accordingly, the barrel can be physically damaged when struck by an outside instrumentality. The delicate moving parts of an unprotected lens system can also become contaminated by the infiltration of dirt and moisture when working outdoors.

In U.S. Pat. No. 4,172,485, a protective device is disclosed that encloses both the camera body and an attached lens within a modular type housing. The portion of the device that covers the lens contains add-on sections that can be joined together to accommodate lenses of varying lengths. Each individual section can also be used as a storage case for a detached lens. A pair of end caps are provided to enclose both ends of the section when a detached lens is stored therein. When not in use the caps can be easily misplaced or lost and, in any event, add to the amount of equipment the photographer is forced to tote. It should also be noted that the protective device does not allow access to the working parts of the camera and, in order to use the camera, the entire housing must be first removed therefrom. This, of course, takes considerable time and effort and thus renders the device wholly unsuitable for use in the field.

It should be further noted that most complex lens systems are relatively long and heavy devices. When mounted upon a camera, the entire assembly generally assumes a nose down attitude when suspended from a carrying strap. Using the strap to lower the camera onto a receiving surface usually results in the distal end of the delicate lens system striking the surface first. Repeated impacting of the lens or dropping the camera from any appreciable height can, of course, cause severe damage to the camera's lens system.

SUMMARY OF THE INVENTION

An object of this invention is to provide an improved protective casing for a photographic lens system.

Another object of this invention is to provide a protective case for a camera lens that can be easily slipped over the lens barrel when the barrel is mounted upon a camera or which can be easily closed to protectively store the lens when the lens is removed from the camera.

Yet another object of the present invention is to provide a protective lens case having a minimum amount of parts which can be used to protect the lens when situated either on or off the camera.

A further object of the present invention is to minimize the effect of impact shock that is normally experienced by a camera lens.

A still further object of the present invention is to permit a camera to be used under adverse conditions without appreciable danger to the camera lens system and without impeding the operation of the camera.

A still further object of this invention is to provide a relatively inexpensive but highly effective camera lens case that can be used to protect the entire barrel of the lens when the lens is situated either on or off the camera.

These and other objects of the present invention are attained by means of a protective case for a camera lens that includes an elongated housing that is closed at one end and open at the other to allow the housing to be slipped over the body of the lens barrel. An end cap is provided for the housing that may be slidably received with a slight interference fit upon either end of the housing. Both the housing and the cap contain an outer shell and a soft resilient inner liner that is designed to encompass the lens barrel and protect it against shock. When the lens is mounted upon the camera, the protective housing is slipped over the exposed length of the barrel and the end cap is slidably mounted upon the closed end of the housing to provide a bumper-like shock absorber for furnishing added protection about the distal end of the lens. When the lens and the housing are removed from the camera, the cap is taken from the closed end of the housing and slidably mounted upon the open end thereof to completely enclose the lens within a protective shield that can be easily stored or transported.

BRIEF DESCRIPTION OF THE DRAWINGS

For a better understanding of these and other objects of the present invention, reference is had to the following detailed description of the invention which is to be read in conjunction with the accompanying drawings wherein.

DESCRIPTION OF THE INVENTION

Figure 1:
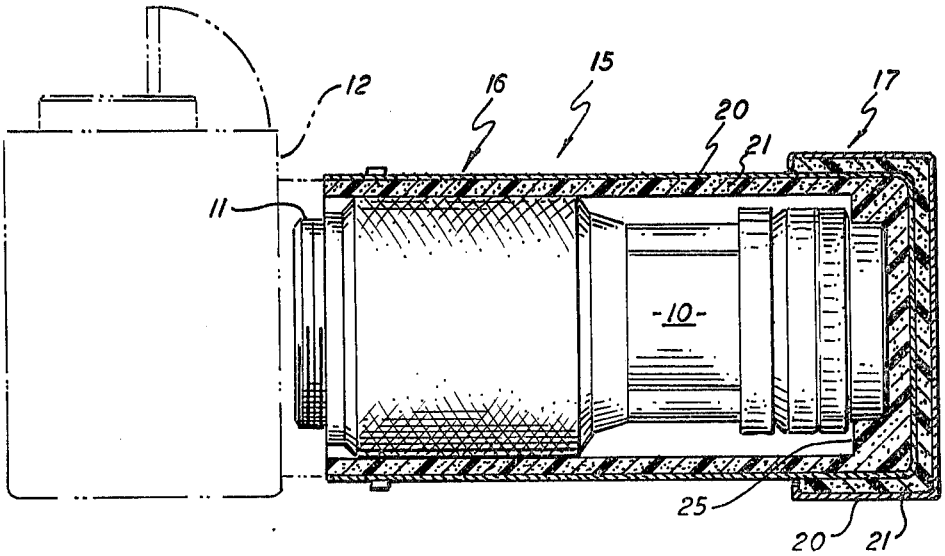
FIG. 1 is a side elevation showing a camera body in phantom outline and a protective lens case that embodies the teaching of the present invention in section with the case being positioned over the lens barrel of the camera.

Referring now to the drawings, and in particular to FIG. 1, a lens system generally referenced 10 is shown mounted upon a camera body 12 which, for purposes of this disclosure, is shown in phantom outline. The construction of the camera body is not important to the invention and it is envisioned that the apparatus of the present invention can be used in conjunction with any type of advanced camera upon which different lens systems may be interchangeably mounted. Most complex cameras of this nature are constructed with a lens mount having either a bayonet or threaded type coupling 11 for connecting the lens to the camera body. Although lens systems come in varying lengths, they typically are all relatively heavy devices that tend to pull the entire camera assembly into a nose down configuration when the camera is suspended from a carrying strap. As noted above, this posture exposes the lens to repeated impacting which eventually can cause damage to the delicate components thereof.

The lens system of the present camera assembly is shown enclosed within a protective case generally referenced 15. The case includes an elongated housing referenced 16 and a single end cap referenced 17. The housing and the end cap are of the same general construction with each having an outer shell 20 and an inner liner 21. The liner is secured to inside walls of the shell by any suitable means as known and used in the art. The shell is preferably fabricated of a relatively stiff or rigid material which is capable of giving form and strength to the overall structure. Such materials as deep drawn metals, impact resistant plastics, and hard leathers have been found suitable for this purpose. Shells formed of many metals and plastics deliver high strength and are highly resistive to soil and corrosion damage. Leather shells which are relatively insensitive to impact damage and thermal stress may also be used.

Both the cap liner and the housing liner are formed of a resilient foam material that is soft enough to be slidably passed over the lens barrel without causing damage thereto. The liner can be formed of an open or closed cell polyurethane or any other polymer material that is similarly tough and durable. An easily worked foam material manufactured by DuPont under the name Microfoam is ideally well suited for use as a liner material because it not only furnishes excellent impact protection but also serves as a dust free abrasion-resistant cushion in regard to the exposed lens parts. In assembly, the liner is permanently bonded to the side wall and the end wall of both the end cap and the housing to completely cover the inside surfaces thereof.

Although the housing can take almost any shape, it is preferred that it be cylindrical in form to minimize space and to provide for ease of handling and manufacture. The length of the housing and the inside diameter of the liner are primarily dictated by the shape of the lens barrel which is to be received therein. The inside diameter of the liner is made slightly less than the largest diameter on the lens barrel to provide a slight interference fit therebetween. The fit permits the barrel to be smoothly passed into the cylinder without binding while at the same time allowing the soft resilient foam to securely embrace the contacted surfaces of the lens barrel. A contoured saddle 25 is formed in the liner at the end wall 26 of the housing. The saddle compliments the typically smaller distal end of the lens barrel and is arranged to provide a secure rest in which the end of the barrel may be seated. The length of the housing is such that the proximal end of the barrel, that is, the end that is coupled to the camera box, protrudes slightly beyond the open end of the housing when the distal end of the barrel is seated upon the saddle. Sufficient clearance is provided between the end of the lens and the housing to permit the lens to be coupled to the camera with the housing in place over the lens barrel as shown in FIG. 1.

By the same token, the housing can be conveniently slipped on or off the lens barrel while the lens is mounted upon the camera. This feature is extremely important when a photographer is forced to work under adverse weather conditions or in areas where there is a high probability that the lens will come in contact with branches or the like that can scratch the lens surfaces or will be exposed to contaminants that can foul the adjusting mechanisms. When the camera is to be used, the housing is simply slipped from the lens barrel and the desired photograph taken. The housing is then replaced until such time as the camera is used once again. Although not shown, a lanyard can be affixed to the housing and another relatively secure object to prevent the housing from becoming lost or otherwise misplaced when removed from the barrel.

Figure 2:
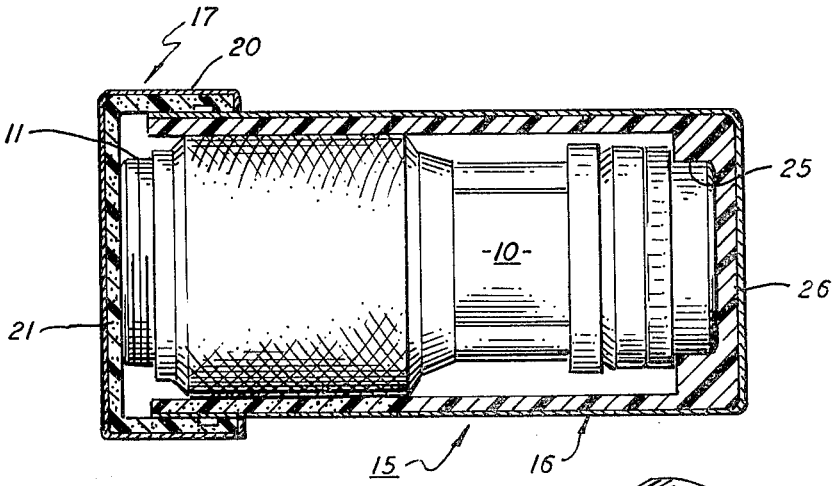
FIG. 2 is a side elevation in partial section showing the protective lens case embodying the teachings of the present invention being used to protectively store a lens that has been removed from the camera body.

In practice, the end cap serves a two fold function. First, where the lens is detached from the camera as illustrated in FIG. 2, the cap is used to close the open end of the housing and thus provide a moisture and dirt tight seal that will thoroughly protect a lens contained within the case. In this arrangement, the case is ideally suited as a means for either storing or transporting the contained lens without fear of its being damaged. Second, when the case is used to protect a lens that is coupled to the camera body, the cap is mounted over the closed end of the housing as shown in FIG. 1. Here, the cap acts as a protective bumper that surrounds the distal end of the contained lens to absorb impact forces that are typically experienced by this part of the lens.

The inside diameter of the end cap liner is made slightly smaller than the outside diameter of the housing shell. As a result of this construction, the end cap can be press fitted over either end of the housing to establish a secure joint therebetween that can withstand a considerable amount of stress before the cap separates from the housing. As a consequence, once positioned over the end of the housing, the cap will tend to stay in place. By making the axial length of the cap about equal to the radius of the cap, sufficient contact area is maintained between the cap and housing to hold the two cojoined members in place under most conditions. The radius of the end cap is preferably equal to the vertical distance between the bottom surface of the camera body and the optical axis of the lens system. Accordingly, when the camera is seated upon a flat surface, the end cap will support the lens in a plane that is parallel with the surface. This, in turn, assures that the bottom surface of the camera body is resting flat against the surface to provide an extremely stable platform for the camera.

Figure 3:
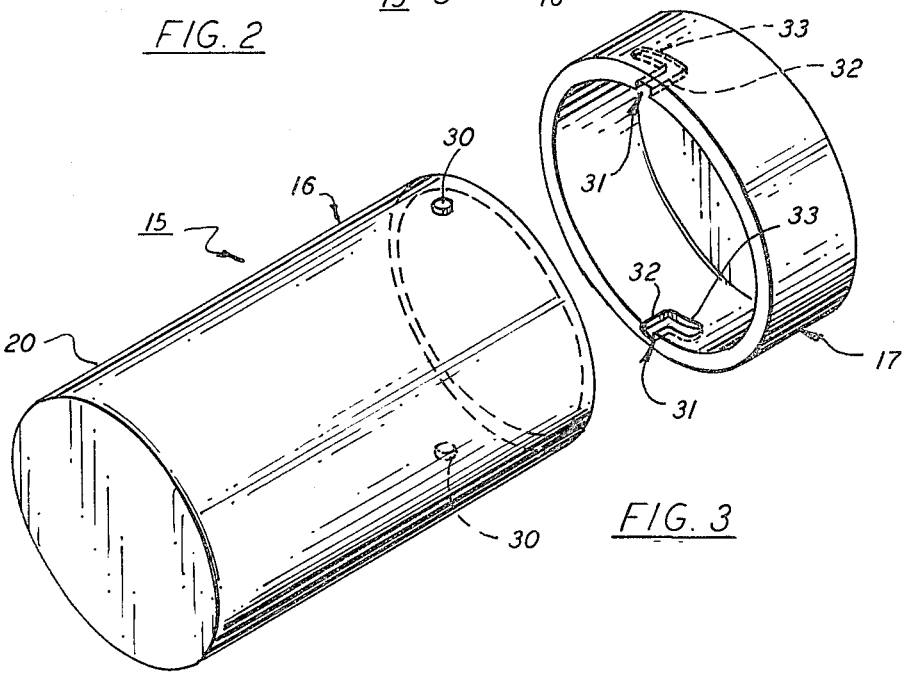
FIG. 3 is a perspective view of the protective lens case of the present invention showing in further detail a locking means for securing the end cap of the case to the main housing.

With further reference to FIG. 3, a bayonet type locking mechanism is used to securely lock the end cap over the open end of the housing. A pair of opposed raised pins 30-30 are secured to the shell of the housing a predetermined distance in from the open end thereof. An opposed pair of receiving tracks 31-31 are secured to the inner surface of the cap shell. Each track includes an axial run 32 that is arranged to turn about 90° into a circumferential run 33. In operation, the pins are guided into the tracks as the cap is passed onto the housing. When the pins reach the bottom of the axial runs, the cap is rotated about its axis to direct the pins into the circumferential runs. The circumferential runs are canted slightly toward the back wall of the cap and thus serve to pull the cap inward against the housing to form a tight seal therebetween.

Figure 4:
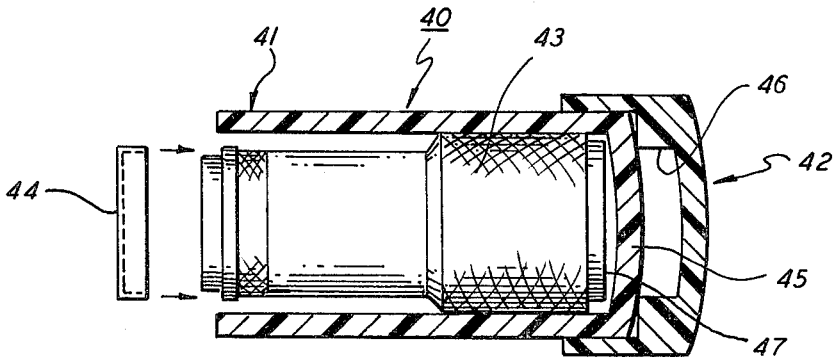
FIG. 4 is a side elevation in partial section showing a further embodiment of the invention with the end cap positioned over the closed end of the case.
Figure 5:
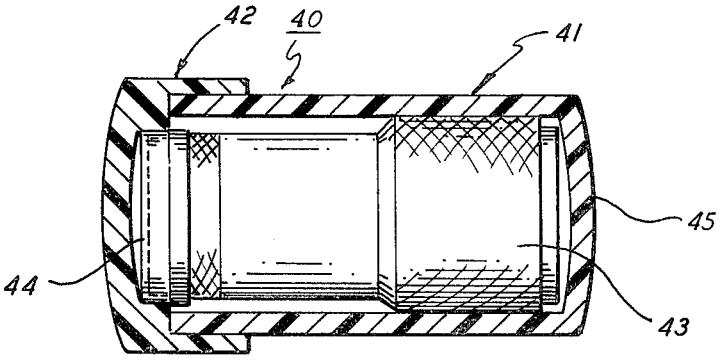
FIG. 5 is a side elevation similar to that of FIG. 4 showing the end cap positioned over the pen end of the case.

With further reference to FIGS. 4 and 5, there is shown a second embodiment, generally referenced 40, of the present invention wherein the case and end cap configuration have been modified to provide protection to a different shaped lens system. In this embodiment, both the housing 41 and the end cap 42 are formed of a cellular material that is capable of retaining its structural form or shape while at the same time presenting a relatively soft contact surface to the lens system 43. The outer surfaces of the housing and the end cap are painted or otherwise coated with an enamel for providing a smooth relatively hard finish to the case.

The blind end wall 45 of the housing is convex and allows for clearance to be maintained between the inside surface of the wall and the exposed optical element carried at the distal end 47 of the lens barrel. As illustrated in the drawings, when the lens system is bottomed against the end wall, only the outer periphery of the barrel rests in contact with the end wall. The optical element, which is typically recessed slightly within the barrel, is thus automatically positioned some distance back from the wall thereby minimizing the danger of the lens becoming dirty or scratched when stored within the case.

As is well known, most if not all interchangeable lens systems come equipped with lens mount caps similar to that referenced 44 in FIGS. 4 and 5. The lens mount cap is adapted to be threaded onto the connector threads found on the proximal end of the lens barrel. In practice, the lens mount cap is designed to prevent dust, dirt and other foreign matter from entering the lens system when it is detached from the camera body. In this embodiment of the invention, the lens system can be conveniently stored within the case with the lens mount cap threaded onto the lens barrel as illustrated in FIG. 5.

End cap 42 contains a circular saddle 46 that projects inwardly from the convex shaped top wall 45 thereof. The circular opening in the saddle is contoured so that the lens mount cap can be seated securely therein when the end cap is passed over the open end of the housing. As can be seen, when the case is closed with a lens system stored therein, the lens will be positively supported at both ends and will be unable to move axially within the case. Accordingly, the lens system will be both shielded from the elements and protected against impact forces.

Again, when the position of the end cap is reversed, as for example when the lens system is mounted upon a camera, the cap will provide added protection about the distal end of the system.

While this invention has been described in reference to the disclosure herein set forth, it is not necessarily limited to this particular embodiment and this application is intended to cover any modifications or changes as may come within the scope of the present invention.

I claim:

1. Apparatus for protecting a camera lens when the lens is either mounted upon the camera body or removed therefrom including a cylindrical housing which is closed at one end by an end wall and open at the other end so that a lens can be passed therein, said housing containing an outer shell and a soft resilient inner liner for protectively contacting the outer surface of a lens barrel contained therein, an end cap that also contains an outer shell and a soft resilient inner liner, and having an inside diameter that is slightly less than the outside diameter of the housing shell to permit the cap to be positioned over the closed end of the housing to provide added protection when the lens is mounted upon the camera and to be positioned over the open end of the housing to totally enclose the lens when said lens is removed from the camera.

2. The apparatus of claim 1 that further includes a locking means having cooperating male and female members acting between the cap and the housing for securing the cap over the open end of the housing.

3. The apparatus of claim 2 wherein said locking means is a bayonet joint.

4. The apparatus of claim 1 wherein both the cap liner and the housing liner are formed of an open celled polymer.

5. The apparatus of claim 4 wherein both the cap shell and the housing shell are formed of a relatively thin high strength material.

6. The apparatus of claim 5 wherein the cap and housing liners are considerably thicker than their respective shells.

7. The apparatus of claim 1 wherein the axial length of the end cap is equal to or greater than the radius of said end cap.

8. The apparatus of claim 1 that further includes a saddle formed in the housing liner at the end wall for cradling the distal end of a contained lens therein.

9. A protective case for a detachable camera lens that can be used to protect the lens when it is either mounted upon the camera body or removed therefom, said case including an elongated housing that is open at one end and closed at the other end by an end wall having a concave inner surface, an end cap that is arranged to be slidably fitted over either end of the housing, said end cap containing an internal circular saddle for engaging the proximal end of a lens in seating engagement therein, the internal surfaces of both said housing and said end cap being formed of a soft resilient material.

10. The case of claim 9 that further includes a locking means acting between the end cap and the housing for securing the end cap in a closed position over the open end of the housing.

11. The case of claim 10 wherein said locking means is a bayonet joint.

12. The case of claim 9 wherein the housing and the cap are formed of a relatively soft polymer containing air cells.

* * * * *